United States Patent [19]

Dauplaise et al.

[11] 4,341,626

[45] Jul. 27, 1982

[54] PROCESS FOR THE FLOTATION OF SULFIDE MINERALS EMPLOYING ALKYLARYL HYDROCARBON COMPOUNDS

[75] Inventors: David L. Dauplaise, New Canaan; D. R. Nagaraj, Stamford, both of Conn.

[73] Assignee: American Cyanamid Company, Stamford, Conn.

[21] Appl. No.: 218,373

[22] Filed: Dec. 22, 1980

[51] Int. Cl.[3] ..... B03D 1/02

[52] U.S. Cl. ..... 209/166; 209/167

[58] Field of Search ..... 209/166, 167; 252/61

[56] References Cited

U.S. PATENT DOCUMENTS

| | | | |
|---|---|---|---|
| 1,350,364 | 8/1920 | Dosenbach | 209/166 |
| 1,438,590 | 12/1922 | Forrest | 209/166 |
| 1,448,929 | 3/1923 | Luckenbach | 209/166 |
| 1,476,530 | 12/1923 | McCullough | 209/166 |
| 1,590,196 | 6/1926 | Klees | 209/166 |
| 1,678,212 | 7/1928 | Adams | 209/166 X |
| 1,830,908 | 11/1931 | Luckenbach | 209/166 |
| 2,894,012 | 4/1959 | Bates | 209/167 |
| 3,414,128 | 12/1968 | Baarson | 209/167 |

FOREIGN PATENT DOCUMENTS

| | | | |
|---|---|---|---|
| 658170 | 2/1963 | Canada | 209/166 |
| 701835 | 1/1965 | Canada | 209/166 |
| 218012 | 6/1924 | United Kingdom | 209/167 |
| 123098 | 4/1958 | U.S.S.R. | 209/166 |

OTHER PUBLICATIONS

Chem. Abst., vol. 72, 1970, 102793g.
Chem. Abst., vol. 74, 1971, 44447h.
Chem. Abst., vol. 86, 1977, 76415k.

*Primary Examiner*—Robert Halper
*Attorney, Agent, or Firm*—Michael J. Kelly; Paul W. Leuzzi, II

[57] ABSTRACT

Alkylaryl hydrocarbons having at least eleven carbon atoms, when used either alone or in combination with known sulfide collectors, result in enhanced recovery and selectivity when used as collectors for sulfide minerals. These alkylaryl hydrocarbons are generally derived from the alkylation of aromatic compounds with the appropriate olefin in synthetic processes. Isopropyl naphthalene appears foremost among these compound as an effective sulfide collector.

11 Claims, No Drawings

PROCESS FOR THE FLOTATION OF SULFIDE MINERALS EMPLOYING ALKYLARYL HYDROCARBON COMPOUNDS

BACKGROUND OF THE INVENTION

Ore flotation is a process for separating finely ground valuable minerals from their associated gaugue or for separating valuable components one from the other. The process is based on the affinity of properly prepared surfaces for air bubbles. In froth flotation, a froth is formed by introducing air into a pulp of the finely divided ore and water containing a frothing agent. Its chief advantage is that it is a relatively efficient operation at a substantially lower cost than many other processes.

Frothing agents are used to provide a stable flotation froth, persistent enough to facilitate the mineral separation, but not so persistent that it cannot be broken down to allow subsequent processing. The most commonly used frothing agents are pine oil (an impure terpineol, $C_{10}H_{17}OH$); creosote and cresylic acid; and alcohols such as 4-methyl-2-pentanol, polypropylene glycols and ethers.

In addition to the frothing agents, the aqueous ore slurry being processed will contain a selected collector which has particular selectivity for the mineral values that are desired to be recovered by froth flotation. Current theory states that the flotation separation of one mineral species from another depends upon the relative wettability of surfaces. Typically, the surface free energy is purportedly lowered by the adsorption of heteropolar surface-active agents. The hydrophobic coating thus provided acts in this explanation as a bridge so that the particle may be attached to an air bubble. The practice of this invention is not, however, limited by this or other theories of flotation. Thus, the slurry containing ore and frother is conditioned with the proper collector and subjected to froth flotation by introducing air into such slurry. A froth is generated by action of the air introduced and the frother. The desired mineral values coated with the selected collector entrap the air bubbles and are levitated as a result, rising into the froth layer which overflows the flotation device. The operation is continued until further build-up of levitated mineral values in the froth ceases. The mineral values recovered by froth flotation of the native ore is designated as the "rougher concentrate" and the residue is designated as the "rougher tails." Subsequently, the rougher concentrate may be subjected to additional froth flotation in one or more operations to provide what are termed "cleaner concentrates" and "cleaner tails." Some operations where the collector is itself a frother agent, it is possible to omit the addition of a frother per se, but in most operations a frother is essential, as is a collector.

Although the art is replete with collectors and frothers which find application in the various flotation processes, there continues a need for new and more efficient collectors and frothers which will either enhance recovery selectivity, or lower the costs involved in the flotation process.

SUMMARY OF THE INVENTION

The instant invention provides a process for the froth flotation of sulfide ore. The process comprises adding to the flotation circuit an effective amount of an alkylaryl hydrocarbon collector wherein the alkylaryl hydrocarbon collector has at least eleven carbon atoms. After the pulp has been effectively conditioned with the collector, air is introduced into the circuit and the sulfide ore values are froth floated and recovered for subsequent processing. This process has resulted in superior recoveries at high selectivity in conventional froth flotation circuits.

DETAILED DESCRIPTION OF THE INVENTION

In accordance with the present invention there is provided a process for the recovery of sulfide ore values. Examples of some commonly floated sulfide ores include chalcopyrite, chalcocite, covellite, bornite, cubanite, valerite, molybdenite, galena, sphalerite, stibnite, arsenopyrite, argentite and the like.

Typically, the sulfide ore is ground to the prescribed size, generally about 100 mesh. The ground sulfide ore is then combined with a quantity of water to produce a pulp slurry having a solids content between 15% to 45%, preferably 20 to 40% solids.

The reagents employed in the instant process may be added entirely or in stages to the grinding mill, the flotation circuit or in both. Included are the frother, collector, and optionally any surfactants, dispersants, depressants or pH modifiers that the particular sulfide ore recovery may require.

The present process provides that the collector employed be an alkylaryl hydrocarbon having at least eleven carbon atoms. These alkylaryl hydrocarbons are generally derived from the alkylation of aromatic compounds such as benzene and naphthalene with the appropriate olefin as distinguished from complex mixtures of petrochemical origin. Suitable alkylaryl hydrocarbons useful in the instant invention include: m-diisopropenyl benzene, isopropyl naphthalene, diisopropyl naphthalene, n-octyl benzene, n-nonyl benzene, isopropenyl naphthalene and the like or mixtures thereof. Preferably, the isopropyl naphthalene is used in the instant process as the collector. Although the amount of collector necessary to obtain effective results may vary depending upon such factors as the specific ore being treated, the amount and nature of the other reagents added to the flotation circuit and the like, generally the amount of collector used should be within the range of 0.1 to 2.0 pounds of collector per ton of ore and preferably in the range of 0.6 to 0.9 pound of collector per ton of ore.

It has additionally been found that the alkylaryl hydrocarbon collectors useful in the instant process can be effectively combined with suitable strong neutral collectors which are soluble in the alkylaryl hydrocarbon collectors of the instant process. Such a combination collector generally exhibits synergistic performance in the froth flotation of sulfide minerals. Suitable strong collectors include, but are not limited to, mercaptans having from 4 to 16 carbon atoms; trithiocarbonates having alkyl or alkenyl groups of 3 to 12 carbon atoms; xanthate esters having alkyl or alkenyl groups of 3 to 12 carbon atoms; thionocarbamates or dithiocarbamates having alkyl or alkenyl groups of 3 to 12 carbon atoms; dimers of dithiophosphates having alkyl or alkenyl groups of 1 to 12 carbon atoms; dimers of dithiophosphinates having alkyl or alkenyl groups of 1 to 12 carbon atoms; dimers of xanthates having alkyl or alkenyl groups of 1 to 12 carbon atoms; and disulfides or polysulfides having alkyl or alkenyl groups of 6 to 16 carbon atoms. In any of these strong collectors branching in the alkyl or alkenyl groups is acceptable so long as it does not sterically hinder the active groups or the interaction of the collector molecule with the mineral surface. When combining the strong collectors with the alkylaryl hydrocarbons useful in the instant process certain ratios of one collector to the other have been observed to be more effective than others. Although the determination of such ratios can easily be arrived at, the following table sets forth some ranges that have been found to be effective when employed in the instant process.

TABLE I

| Strong Collector | Percent of Total Combination Collector |
|---|---|
| Mercaptans | 0.1–10%, preferably 4% |
| Trithiocarbonates | 1–50%, preferably 5–20% |
| xanthate esters | 1–50%, preferably 5–25% |
| Dimers of Dithiophosphates | 1–50%, preferably 5–25% |
| Dimers of Dithiophosphinates | 1–25%, preferably 2–10% |

The froth which helps levitate the mineral values is generated by the introduction of a gas, normally air, into the flotation circuit where a suitable frother has been added. Typically, the frother is a pine oil, a creosote or cresylic acid, an alcohol, a polyoxyalkylene or polyalkylene glycol or the like. The frother should generally be added in an amount ranging from 0.01 to 0.5 pound of frother per ton of ore.

It is of significant interest that the employment of the alkylaryl hydrocarbons, useful as collectors in the instant process, as a component in the frother make-up has demonstrated a marked increase in recoveries where collectors unassociated with the instant process were employed. Whether this presence has contributed to the collector properties of the frother by adsorbing independently at the solid-liquid or solid-gas interface or, alternatively, has modified the frother itself by adsorbing at the liquid-gas interface remains a matter of speculation. In any event its presence in any of the interfaces will facilitate attainment of the 3-phase contact that is necessary prior to bubble-particle attachment. Since the overall amount of alkylaryl hydrocarbon is small, about 30% of the frother, it may be inaccurate to attribute the enhanced recovery to its collector functions alone. The surfactants which may be employed in the instant process may be any conventional surfactant which promotes wetting of the collector on the mineral ore surface, typically they are employed in amounts ranging from 0.01 to 0.20 pound of surfactant per ton of ore. Suitable conventional surfactants include, but are not limited to, alkyl sulfates, alkyl sulfonates, alkyl sulfosuccinate, and nonionic polyalkylene glycols.

The dispersants suitable for being employed in the present invention are generally any conventional dispersant, such as sodium silicate or one of the alkaline phosphates. These dispersants, when employed, should be added in amounts ranging from 0.1 to 2.0 pounds of dispersant per ton of ore. Those depressants useful in the present invention generally include lime; cyanides; sodium and calcium sulfides and hydrosulfides; sodium or potassium dichromates; perchlorates; sulfur dioxide with causticized starch; and the like. The depressants, when employed, generally are added in amounts ranging from 0.001 to 5.0 pound of depressant per ton of ore. The pH modifiers act to control the alkalinity or acidity of the circuit as well as counteract any interfacing effect of detrimental slimes, colloids and soluble salts. Commonly these reagents include lime, soda ash, caustic soda, sulfuric acid, sodium silicate and the like. Generally, when a pH modifier is employed anywhere from 0.05 to 1.5 pounds of modifier may be employed per ton of ore.

Although the flotation process proceeds well at ambient temperatures, it may be advantageous to carry it out at a temperature within the range of from 40° to 60° C. wherein overall efficiencies appear at a maximum.

Whereas the exact scope of the instant invention is set forth in the appended claims, the following specific examples illustrate certain aspects of the present invention and more particularly point out methods of evaluating the same. However, the examples are set forth for illustration only and are not to be construed as limitations on the present invention except as set forth in the appended claims. All parts and percentages are by weight unless otherwise specified.

EXAMPLES 1–2

About 1 kg of −10 mesh primary molybdenite ore assaying approximately 0.3% $MoS_2$ is charged into 7 inch laboratory ball mill containing about a 12 kg ball charge. About 0.1 lb/t of the collector, 0.052 lb/t pine oil, 0.2 lb/t lime, 0.006 lb/t sodium cyanide, 0.66 lb/t silicate, 0.03 lb/t Noke's reagent (phosphorous pentasulfide+sodium hydroxide, 1:2), and 500 ml water containing calcium and sulfate to simulate plant water, are added to the mill and the contents ground for 8 minutes. The ground material is transferred to the flotation cell, more water is added to obtain a pulp density of about 34% solids. The pulp conditioned for 2 mins., and is floated for 2 mins. The pulp is then further conditioned for 1 min. and floated for 2 min., and this is repeated for the third stage. The results obtained are given in Table II.

COMPARATIVE EXAMPLE A

Following the procedures of Examples 1–2 in every material detail a vapor oil* collector is employed. Test results are set forth in Table II.

COMPARATIVE EXAMPLE B

Following the procedure of Examples 1–2 in every material detail a #2 fuel oil collector is employed. Test results are set forth in Table II.

TABLE II

| Example Number | Collector | Dosage (lb/t) | % $MoS_2$ Recovery |
|---|---|---|---|
| 1 | Isopropyl Naphthalene | 0.1 | 88.3 |
| 2 | Diisopropyl Naphthalene | 0.1 | 88.6 |
| Comp. A | Vapor Oil* | 0.1 | 87.5 |
| Comp. B | #2 Fuel Oil | 0.1 | 84.8 |

EXAMPLES 3–4

The same procedure is followed as in Examples 1–2 except that 0.7 lb/t of collector instead of 0.1 lb/t and 0.05 lb/t of syntex which is a sulfated coconut oil surfactant are used. The results obtained are shown in Table III.

TABLE III

| Example Number | Collector | Dosage (lb/t) | Surfactant (0.05 lb/t) | % $MoS_2$ Recovery |
|---|---|---|---|---|
| 3 | Isopropyl Naphthalene | 0.7 | Syntex | 94.3 |

TABLE III-continued

| Example Number | Collector | Dosage (lb/t) | Surfactant (0.05 lb/t) | % $MoS_2$ Recovery |
|---|---|---|---|---|
| 4 | Diisopropyl Naphthalene | 0.7 | " | 94.6 |
| Comp. A | Vapor Oil* | 0.7 | " | 94.0 |
| Comp. B | #2 Fuel Oil | 0.7 | " | 92.1 |

*Petroleum based hydrocarbon oil

EXAMPLE 5

Following the procedure of Examples 1–2, except for using 0.05 pound of syntex collector per ton of ore, the following experiments were run under the conditions set forth below. Test results are found in Table IV.

TABLE IV

| Collector | Dosage #/ton | Grade | Recovery |
|---|---|---|---|
| Vapor Oil | 0.7 | 4.64 | 93.6 |
| Fuel Oil | " | 3.39 | 93.3 |
| Isopropyl naphthalene | " | 3.28 | 94.7 |
| Diisopropyl naphthalene | " | 2.76 | 94.9 |
| $C_{10-12}$ monoalkylbenzene | " | 3.49 | 94.5 |
| $C_{11-13}$ monoalkylbenzene | " | 3.57 | 94.3 |
| $C_{12-14}$ monoalkylbenzene | " | 3.83 | 94.7 |
| monododecylbenzene | " | 3.57 | 92.3 |
| monotridecylbenzene | " | 3.23 | 93.7 |

EXAMPLE 6

Following the procedure of Example 5 in every material detail, the following experiments are run using a combination collector. Test results are set forth in Table V.

TABLE V

| Collector | Dosage #/ton | Grade | Recovery |
|---|---|---|---|
| 75% IPN* 25% di-n-butyl trithiocarbonate | 0.7 | 2.99 | 95.8 |
| 75% IPN 25% di-allyl trithiocarbonate | 0.7 | 2.47 | 95.7 |
| 90% IPN 10% diallyl trithiocarbonate | 0.7 | 3.56 | 94.8 |
| 90% diphenylalkane 10% diallyl trithiocarbonate | 0.7 | 2.78 | 95.7 |
| 75% IPN 25% amylallylxanthate ester | 0.7 | 2.69 | 94.7 |
| 75% IPN 25% xanthate ester of methyl carbitol | 0.7 | 1.83 | 95.4 |

*IPN - isopropyl naphthalene

EXAMPLE 7

Following the procedure of Example 5 in every material detail, the following experiments are run using a combination collector. Test results are set forth in Table VI.

TABLE VI

| Collector | Dosage #/ton | Grade | Recovery |
|---|---|---|---|
| 95% IPN* 5% n-dodecylmercaptan | 0.7 | 3.20 | 94.8 |
| 95% IPN 4% n-dodecylmercaptan 1% polypropyleneglycol | 0.7 | 3.25 | 96.0 |

TABLE VI-continued

| Collector | Dosage #/ton | Grade | Recovery |
|---|---|---|---|
| 95% IPN 5% n-octyl mercaptan | 0.7 | 3.43 | 95.2 |
| 95% IPN 5% t-butyl mercaptan | 0.7 | 2.95 | 95.1 |
| 95% IPN 4% t-butyl mercaptan 1% polypropyleneglycol | 0.7 | 2.69 | 95.9 |
| 90% IPN 10% n-octyl mercaptan | 0.7 | 3.26 | 95.4 |
| 75% IPN 25% sodium di[diisobutyldithiophosphate] | 0.7 | 3.40 | 95.0 |
| 90% IPN 10% sodium di[diisobutyldithiophosphate] | 0.7 | 3.33 | 94.7 |
| 75% IPN 25% sodium di[diisoamyldithiophosphate] | 0.7 | 2.70 | 95.0 |

*IPN = isopropyl naphthalene

EXAMPLE 8

Following the general procedure of Examples 1–2, a series of experiments are run without a surfactant or collector to show the use of an alkylaryl hydrocarbon as a frother. Test results are set forth in Table VII.

TABLE VII

| Frother | Dosage | Grade | Recovery |
|---|---|---|---|
| Pine Oil | 0.052 | 3.25 | 73.3 |
| Methylisobutylcarbinol | 0.052 | 4.58 | 71.5 |
| Polypropylene glycol | 0.052 | 3.78 | 85.0 |
| | | 3.42 | 83.5 |
| $C_{6-7}$ Alcohol | 0.052 | 4.21 | 75.8 |
| IPN C-7 alcohol | 0.052 | 3.77 | 82.2 |
| methylisobutylcarbinol | 0.052 | 4.67 | 78.7 |
| IPN $C_{6-7}$ alcohol | 0.052 | 3.66 | 82.7 |
| methylisobutylcarbinol | 0.052 | 4.75 | 83.3 |

We claim:

1. A process for the froth flotation of sulfide ores comprising adding to a flotation circuit an effective amount of a frother and a collector wherein said collector is of the general formula $$R_1—(—R—)—R_2$$

wherein (a) R is benzene or naphthalene;

(b) $R_1$ and $R_2$ are alkyl or alkenyl groups having at least three carbon atoms each, except that $R_1$ may have less than three carbon atoms or may be hydrogen if:

(i) R is naphthalene; or (ii) $R_2$ is more than six carbon atoms; and (c) the total number of carbon atoms of $R_1$, $R_2$ and $R_3$ taken together is not greater than about 20; and wherein said collector is derived from alkylating an aromatic compound with an olefin, conditioning the sulfide ore, introducing a gas into the circuit to effect frothing and thereafter recovering the mineral values.

2. The process of claim 1 wherein the collector is selected from the group consisting of m-diisopropenyl benzene, isopropyl naphthalene, isopropenyl naphthalene, diisopropyl naphthalene, dodecylbenzene n-octyl benzene, and n-nonyl benzene.

3. The process of claim 1 wherein the effective amount of the collector is within the range of 0.1 to 2.0 pounds of collector per ton of ore.

4. The process of claim 1 wherein the sulfide ore is molybdenite.

5. The process of claim 1 wherein the flotation circuit optionally includes a surfactant, dispersant, depressant and/or pH modifier.

6. The process of claim 1 wherein the collector is isopropylnaphthalene.

7. A process for the froth flotation of sulfide ores comprising adding to a flotation circuit an effective amount of a frother and a combination collector wherein said combination collector comprises a compound of the general formula $$R_1—(—R—)—R_2$$

wherein (a) R is benzene, or naphthalene;

(b) $R_1$ and $R_2$ are alkyl or alkenyl groups having at least three carbon atoms each, except that $R_1$ may be less than three carbon atoms or may by hydrogen if:

(i) R is naphthalene; or (ii) $R_2$ is more than five carbon atoms; and (c) the total number of carbon atoms of $R_1$, $R_2$ and $R_3$ taken together is not greater than about 20; and a composition selected from the group consisting of mercaptans, trithiocarbonates, xantate esters, thionocarbamates, dithiocarbamates, dimers of dithiophosphates, dimers of dithiophosphinates, dimers of xanthates, disulfides and polysulfides, conditions the sulfide ore, introducing a gas into the circuit to effect frothing and thereafter recovering the mineral values.

8. The process of claim 7 wherein the collector is selected from the group consisting of m-diisopropenyl benzene, isopropyl naphthalene, isopropenyl naphthalene, diisopropyl naphthalene, n-octyl benzene, dodecylbenzene, and n-nonyl benzene.

9. The process of claim 7 wherein the sulfide ore is molybdenite.

10. The process of claim 7 wherein the collector is isopropylnaphthalene.

11. The process of claim 7 wherein the flotation circuit optionally includes a surfactant, dispersant, depressant and/or pH modifier.

* * * * *